US005368532A

United States Patent [19]

Farnet

[11] Patent Number: 5,368,532

[45] Date of Patent: Nov. 29, 1994

[54] TREADMILL HAVING AN AUTOMATIC SPEED CONTROL SYSTEM

[75] Inventor: Michael G. Farnet, Auburn, Ala.

[73] Assignee: Diversified Products Corporation, Opelika, Ala.

[21] Appl. No.: 13,020

[22] Filed: Feb. 3, 1993

[51] Int. Cl.[5] ..... A63B 23/00
[52] U.S. Cl. ..... 482/5; 482/54
[58] Field of Search ..... 482/5, 7, 54, 901, 902; 119/29

[56] References Cited

U.S. PATENT DOCUMENTS

| | | |
|---|---|---|
| 1,919,627 | 7/1933 | Fitz Gerald . |
| 3,518,985 | 7/1970 | Quinton . |
| 3,737,163 | 6/1973 | Sumrall . |
| 4,643,418 | 2/1987 | Bart . |
| 4,708,337 | 11/1987 | Shyu . |
| 4,720,093 | 1/1988 | Del Mar . |
| 4,749,181 | 6/1988 | Pittaway et al. . |
| 4,842,266 | 6/1989 | Sweeney, Sr. et al. . |
| 4,865,313 | 9/1989 | Kuo . |
| 5,016,871 | 5/1991 | Dalebout et al. . |
| 5,100,127 | 3/1992 | Melnick et al. . |

FOREIGN PATENT DOCUMENTS

| | | |
|---|---|---|
| 1565617 | 3/1969 | France . |
| 2624383A | 6/1989 | France . |
| 825122 | 4/1981 | U.S.S.R. . |
| 1463323 | 3/1989 | U.S.S.R. . |

*Primary Examiner*—Richard J. Apley
*Assistant Examiner*—Glenn E. Richman
*Attorney, Agent, or Firm*—Banner, Birch, McKie & Beckett

[57] ABSTRACT

An improved treadmill comprises a motor driven endless belt, sensors located below an upper run of the belt for sensing the position of a user, and a controller for controlling the speed of the belt in accordance with the position of the user relative to the sensors. The detection or lack of detection of the user by the sensors can cause the belt to accelerate, decelerate, remain at a constant speed, or stop. A proper sequence of user detections by the sensors permits the controller to initiate an automatic speed adjusting system. The controller also provides a safety system for stopping the belt. In one embodiment, the controller stops the belt upon a lack of the sensors detecting the user. In another embodiment, a safety sensor is mounted on an upper surface of a member located proximate the belt, and the controller stops the belt when the safety sensor senses the user.

31 Claims, 10 Drawing Sheets

TREADMILL HAVING AN AUTOMATIC SPEED CONTROL SYSTEM

BACKGROUND OF THE INVENTION

The present invention relates to an exercise device having an endless surface, and more particularly to a treadmill having a motor driven endless belt with the capability of automatically changing the speed of the belt in accordance with the position of a user relative to the treadmill.

Treadmills are usually motor driven with the speed of the belt being adjustable by a user reaching forward and pressing correct buttons on a console. However, running on a treadmill, especially at speeds in excess of 8 miles per hour, requires an extra amount of coordination when adjusting the speed on the console, as it is difficult to adjust the speed on the console without breaking stride or falling. Therefore, a workout on a treadmill can be made safer and more effective by automatically controlling the speed of the belt.

Motor driven treadmills which do not require the user to manually adjust a control knob to adjust the belt speed can be categorized into two types. The first type adjusts the belt speed as a function of a user's biological functions and the second type adjusts the belt speed as a function of a user's position relative to the treadmill.

The most common variety of the first type automatically controls the belt speed as a function of a user's heart rate. One such device is U.S. Pat. No. 3,518,985 to Quinton, providing an electrocardiograph pickup device attached to the user detecting the user's heart rate, and a controller adjusting the belt speed to keep the user's heart rate to a predetermined selected value. While treadmills of this type of control system may be preferred for heart patients, many users prefer to run on treadmills which are more performance oriented as opposed to health oriented.

Treadmills of the second type, which automatically control the belt speed in accordance with the position of the user, are desirable because they permit the user to adjust the belt speed by merely changing their pace, thus simulating natural conditions more closely. French Patent 1,565,617, U.S. Pat. No. 1,919,627 issued to Fitzgerald, and U.S. Pat. No. 4,708,337 issued to Shyu are three examples of devices which fall within this second type.

French Patent 1,565,617 discloses a motor driven treadmill having sensors placed at the sides of the treadmill of sensing the position of the user. There are five sensors arranged from the front to the rear of the treadmill. Each sensor consists of an incandescent lamp and photoelectric cell. The sensors feed signals to an electric circuit controlling the motor which drives the treadmill belt. The sensor closest to the rear of the treadmill turns the motor on and sensor closest to the front of the treadmill turns the motor off. The three sensors in the middle make it possible to increase or reduce the speed of the motor in accordance with the sensed position of the user.

U.S. Pat. No. 1,919,627 issued to Fitzgerald provides a motor driven treadmill automatically controlled by the position of the user's body with respect to an electrostatic sensor fixedly mounted to the treadmill. The sensor is an arrangement of capacity plates or electrodes located at the forward end of the treadmill and senses the location of the user by being electrically influenced due to electrical capacity of the user's body.

U.S. Pat. No. 4,708,337 issued to Shyu discloses a motor driven treadmill wherein the belt is driven by a motor automatically controlled by the position of the user's body. The position of the user's body is sensed by an ultrasound sensor mounted on the control panel. The speed of the drive motor is adjusted as a function of the position of the user as sensed by the ultrasound sensor.

Although the above-described treadmills automatically increase and decrease the belt speed as a function of the position of a user, they include disadvantages which make them more susceptible to damage and less accurate.

The location of the sensors for each above-described treadmill which sensing the position of a user are located above the belt surface, the photoelectric sensors are mounted on side rails and the electrostatic and ultrasound sensors being mounted on the front console. As these sensors are mounted in areas which can be contacted, they are susceptible to damage by being bumped or struck by objects and persons, causing malfunctions in the treadmill. Additionally, many of these sensor arrangements may be cost prohibitive to implement on treadmills in today's marketplace.

The sensors for each of the treadmills are also less accurate than many users desire. For example, the photoelectric sensors are affected by baggy jogging clothes which pass through the light beam provided by the incandescent lamp causing false hits. Photoelectric sensors are also susceptible to dust accumulation producing false hits. An observer standing adjacent the running surface can also produce a false hit upon accidentally touching the side rails and crossing the path of light. Additionally, the photoelectric sensors require alignment between a lamp, a reflector, and a receiver, which makes them difficult to manufacture and susceptible to malfunction with the slightest misalignment.

Electrostatic sensors are not accurate because they are affected by many different factors including the temperature and humidity conditions, the degree of particulate matter in the air, electromagnetic interference produced by the drive motor and the clothing worn by user. Therefore, it is possible that while a user is having problems keeping up with the belt speed, an electrostatic sensor can pick up particulate matter in the air and falsely register that the user is proximate the front of the treadmill, and subsequently accelerate the belt forcing the user to dismount the treadmill and possibly causing injury.

Ultrasonic sensors are not desirable because they are geared to detect the position of the user by sensing the torso of the user and they could produce false hits if the user raises their arms. Further, ultrasound sensors may not be as accurate as some users desire because adjusting the belt speed as a function of the posture of the user causes the belt to speed up or slow down by leaning forward or backward, even if the user is sustaining the same pace as the belt.

SUMMARY OF THE INVENTION

In view of the foregoing, it is a principal object of the present invention to provide an improved automatic speed control system for a treadmill.

More specifically, it is an object of the invention to provide a treadmill with automatic speed control which utilizes a novel sensor placement.

Another object is to allow a treadmill user the ability to adjust the speed of the belt to more realistically simulate walking and jogging conditions.

It is yet another object of the invention to provide a reliable and inexpensive automatic control system which is not affected by the ambient temperature or humidity or the user's jogging posture or clothing, and which is less susceptible to damage.

A still further object of the invention is to provide an improved safety system which automatically stops the belt upon sensing the lack of a signal from pressure sensors within a predetermined number of belt revolutions.

It is an additional object of the present invention to provide safety sensors mounted to the side rails of the treadmill to stop the belt if the user has fallen or dismounted the treadmill.

Another object of the invention is to provide a start-up routine which must be correct performed in order to initiate a automatic speed control system.

These and other objects are achieved by the present invention which, according to one aspect, provides a treadmill having a movable endless belt having an upper running surface, a motor for rotating the belt, a sensing device located below the upper surface of the belt for sensing the position of a user, and a controller for controlling the speed of the belt in accordance with the position of the user relative to the sensing device.

In a second aspect, the invention provides a control system for an exercise apparatus having a movable support surface and motor. The control system of the invention includes a controller, and front and rear sensors providing a signal to the controller in response to the weight of a user proximate thereto. The controller being designed to increase the speed of the support surface in response to receiving a signal from the front sensor and decrease the speed of the support surface in response to receiving a signal from the rear sensor.

In another aspect, the invention provides a method of controlling the speed of exercise equipment having a rotatable endless support surface, a motor for driving the endless surface, a controller for controlling the speed of the motor, and first and second sensing devices for determining the position of a user. The method including rotating the endless support surface at a constant speed. The method also including the steps of accelerating the speed of the endless support surface upon two consecutive detections of the user by the front sensor and stopping the accelerating step upon a detection of the user by the rear sensor. Additionally, the method includes the steps of decelerating the speed of the endless support surface upon two consecutive detections of the user by the rear sensor and stopping the decelerating step upon a detection of the user by the front sensor. The method also includes the steps of maintaining the speed of the endless support surface constant upon the detection of the user by the front sensor followed by the detection of the user by the rear sensor or upon the detection of the user by the rear sensor followed by the detection of the user by the front sensor.

In yet another aspect, the invention provides an exercise apparatus having a movable endless belt having an upper run for a user to walk or run upon, a motor for moving the belt, at least one sensor for sensing the position of the user on the belt and a controller for stopping the belt in accordance upon the failure of said at least one sensor to sense the proximate position of the user.

In another aspect, the invention provides a method of controlling exercise equipment having a rotatable endless surface, a motor for driving the endless surface, a controller for controlling the speed of the motor, and front and rear sensors for detecting the position of a user. The method including the steps of moving the endless support surface, detecting the relative position of the user on the endless support surface by the front and rear sensors, comparing the detections of the relative position of the user on the endless support surface by the front and rear sensors to a sequence of detected relative positions, the sequence including a predetermined order of detected relative positions by the front and rear sensors, and initiating a speed control system upon completion of said determining step if the detected relative positions of the user on the endless support surface by the front and rear sensors are in the same order as the sequence of detected relative positions.

These and other objects and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENT

Figure 1:
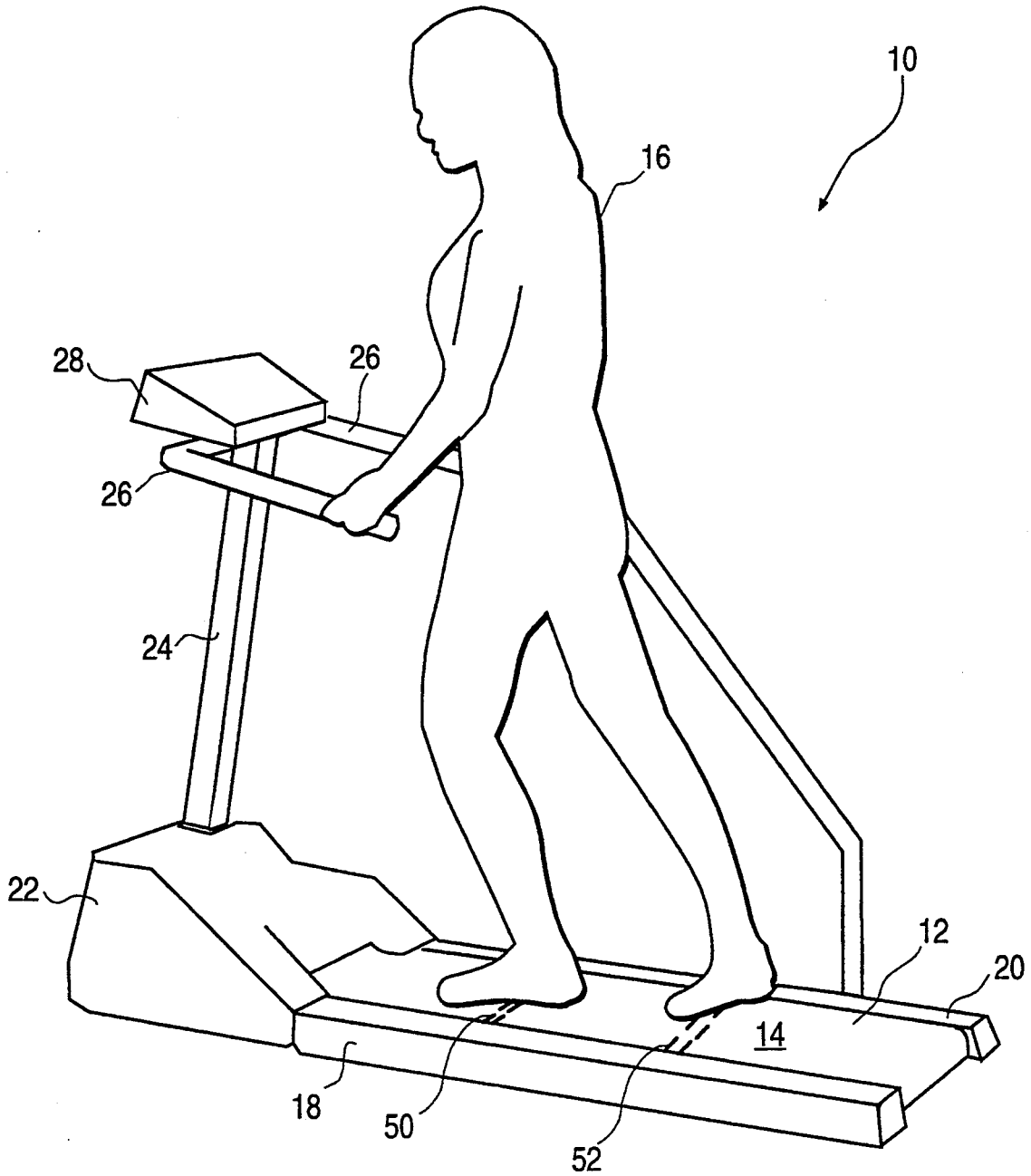
FIG. 1 is a perspective view of a first embodiment of the treadmill according to the present invention.

In the first embodiment of the present invention, as pictured in FIGS. 1–10, a treadmill is designated generally by reference numeral 10. Treadmill 10 includes an endless belt 12 having an upper run 14 which provides a support surface upon which a user 16 may stride upon, e.g., walk, jog or run. Belt 12 is supported by a frame which includes a left side member 18, a right side member 20 and a front housing 22 for rotational movement therebetween. Attached to front housing 22 is an upright post 24 for supporting handrails 26 and a console 28.

Figure 2:
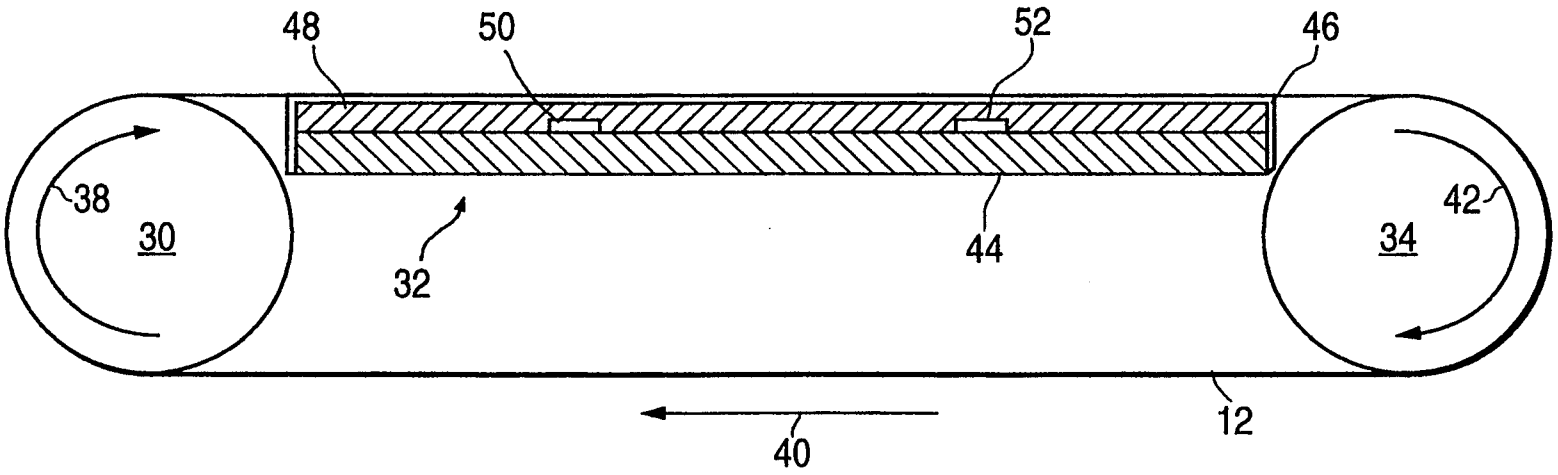
FIG. 2 is a cross section of the belt and the supporting structure for the treadmill of FIG. 1.

As best shown by FIG. 2, belt 12 circumscribes a front roller 30, a bed 32, and rear roller 34. Electric motor 36, not shown in FIG. 2, is drivingly coupled to front roller 30, such that rotation of motor 36 rotates front roller 30 in the direction of arrow 38 causing belt 12 to rotate in the direction of arrow 40, and such that changing the speed of motor 36 creates a relative speed change in front roller 30 and belt 12. The coupling of motor 36 to front roller 30 may include gears, belts, speed reducers, etc., in a manner well known in the art to accomplish this function. Rear roller 34 idles about an axis rotating at the same speed as front roller 30 in the direction of arrow 42 because of friction imparted thereto from belt 12. It should be noted that the driven and idle arrangement of the front and rear rollers 30, 34 could be reversed such that front roller 30 is an idler roller and rear roller 34 is driven by motor 36, without departing from the scope of the invention.

Bed 32 includes a running deck 44 made out of wood or another similar load beating material, which is encased in front, on top, and in back by a cover 46 made out of MYLAR or another similar material with a slick upper surface providing a low coefficient of friction. Located on an upper portion of bed 32 between running deck 44 and cover 46 is cushioning material 48 comprised of a foam cushion reducing the stress the knees and ankles of the user.

An acceleration sensor 50 and a deceleration sensor 52 are pressure sensors positioned between running deck 44 and cushioning material 48 sensing the proximity of the user thereto. Sensors 50, 52 are preferably placed between a single solid sheet of cushioning material 48 and running deck 44. However, if desired, grooves may be formed in the underside of cushioning material 48 to accommodate sensors 50, 52 or other provisions may be made to accommodate sensors 50, 52. For example, cushioning material 48 need not be a singular cushion, and could be comprised of cushion sections accommodating sensors 50, 52 therebetween.

Upon contact by the user on belt 12 immediately above a sensor, cover 46 and cushioning material 48 therebetween deflects into the sensor conveying a signal to a controller 54. Sensors 50, 52 are preferably tape switches, however, pneumatic tubes, piezoelectric sensing elements, and other types of pressure sensing devices could be effectively used to sense pressure applied to running surface 14 by user 16.

Sensors 50, 52 are located midway between the front and rear of running surface 14 and spaced approximately 18 inches apart. This separation is ideal because the user, during a normal stride, contacts both front acceleration sensor 50 and rear deceleration sensor 52 with each foot, during each stride. The characteristics and functioning of the automatic speed control system will be described in more detail hereinafter.

Figure 3:
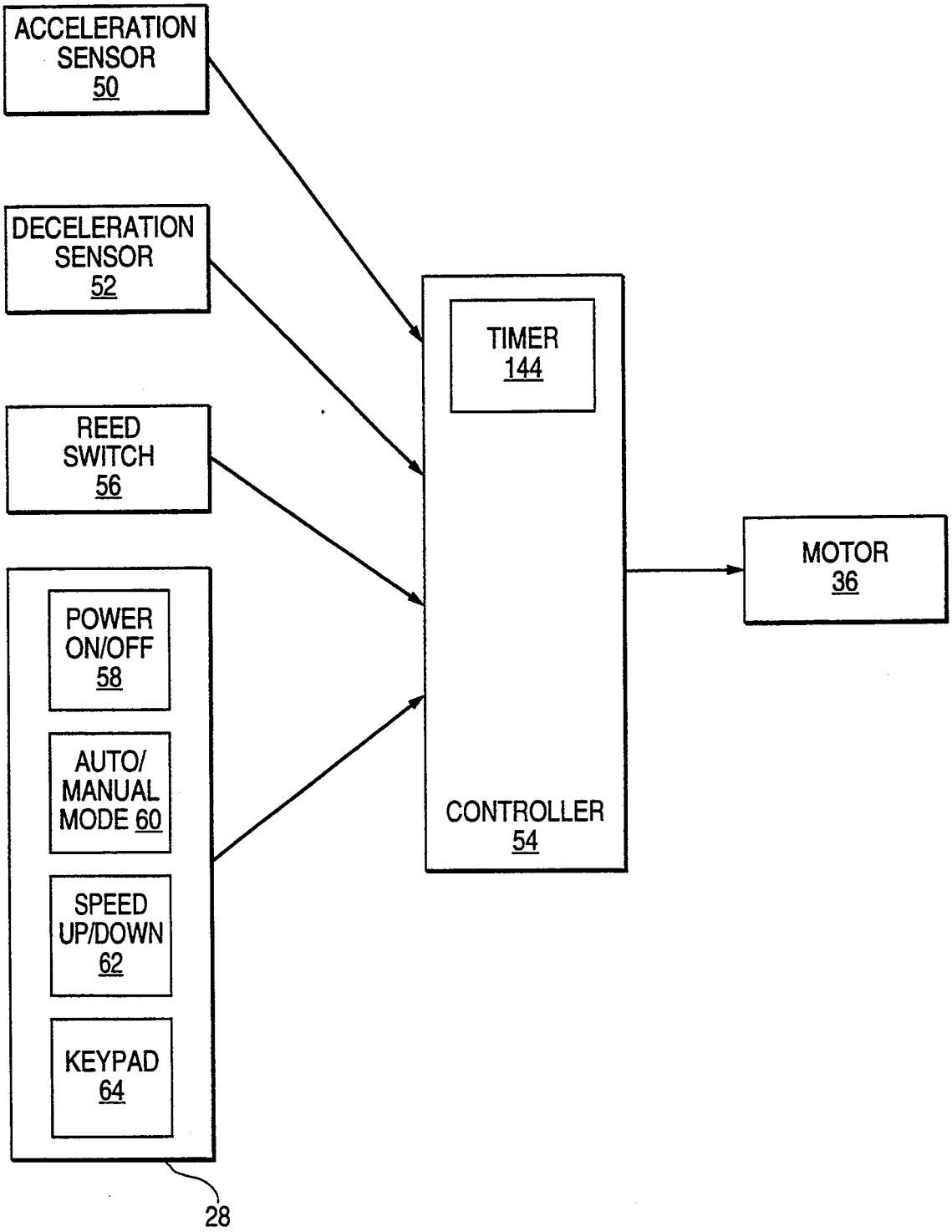
FIG. 3 is a schematic functional diagram of the treadmill of FIG. 1.

As best shown by FIG. 3, acceleration and deceleration sensors 50, 52, a reed switch 56, and console 28 convey signals to controller 54 which processes the signals and outputs a signal controlling motor 36 to drive belt 12 according to the flow charts described hereinafter. Controller 54 is preferably a microprocessor, however a programmable logic array or well-known sequential or combination logic circuitry can also be used to accomplish the processing function.

Console 28 includes a power control 58, an auto/-manual control 60 to choose a manual mode or an automatic speed control mode, a speed up/down control 62 permitting user to manually increase or decrease the speed of the belt 12, and a keypad 64 permitting user to enter various data parameters, change certain operating features, or cause a screen, not pictured to display various parameters as is well known in the art. Power control 58 may be a key, a button or another type of switch as is well known in the art.

Controller 54 includes provisions for an automatic speed control system, a start-up sequence which must be performed to initiate the automatic speed control system, and an automatic shutoff system for stopping the motor.

The controller 54 includes an automatic speed control system and controls the speed of belt 12 in accordance with the position of user 16 relative to sensors 50, 52, operating on the principle that sensors 50,52 are placed close enough together so that a user running in the middle of the running surface 14, will contact both sensors once during each leg stroke. During constant strides by the user at the same speed as the belt, the belt should ideally stay at the same speed. For example, during a normal stride, a user's right foot should contact the acceleration sensor 50 first. Due to the movement of the belt and the user's stride, the user's right foot should continue to move backwards and contact deceleration sensor 52. Shortly thereafter, the user's right foot will step off the running surface and the user's left foot will first contact acceleration sensor 50 and near the end of a stride, it will contact deceleration sensor 52.

If user 16 correctly performs the start-up sequence, the automatic speed control system initiates with the motor moving at a constant minimum speed at 66. In the automatic speed control system, controller 54 accelerates the belt speed if the user is moving too fast for the present belt speed, decelerates the belt speed if the user is moving too slow for the present belt speed and maintains the belt speed at a constant if the runner is moving at the same speed as the belt.

Figure 4:
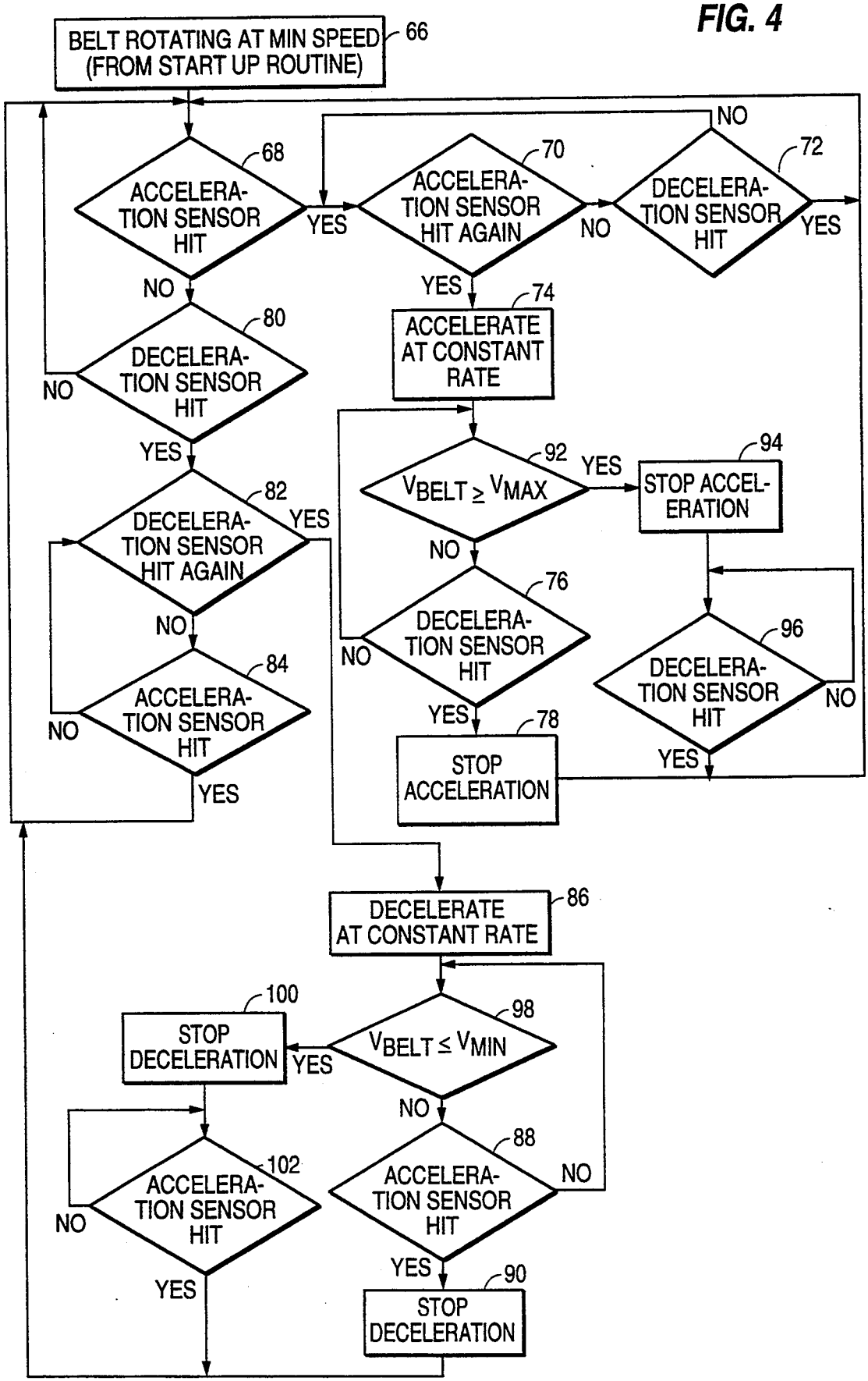
FIG. 4 is a flow chart for the speed control system for the treadmill of FIG. 1.

As shown in the flow chart of FIG. 4, controller 54 starts in a normal sensing mode determining whether acceleration sensor 50 is contacted at 68. If acceleration sensor 50 has been contacted, controller 54 tries to determine if user 16 is moving too fast for the belt 12 or if user 5 is keeping up with the belt 12. It determines this by checking to see which sensor is subsequently contacted at 70 and 72. If deceleration sensor 52 is subsequently contacted at 72, controller 54 maintains the speed of belt 12 constant because user 16 is contacting sensors 50, 52 in a manner consistent with keeping pace with the present belt speed. However, if user 16 contacts acceleration sensor 50 a second consecutive time at 70, controller 54 enters an acceleration mode because user 16 is moving faster than the speed of belt 12.

In the acceleration mode, controller 54 accelerates the belt speed at a constant rate at 74, until deceleration sensor 52 is contacted at 76. Upon contacting deceleration sensor 52, controller 54 terminates the acceleration at 78 and reenters normal sensing mode because user 16 has reached the desired belt speed.

The deceleration part of the automatic speed control system works similar to that of the acceleration part. If deceleration sensor 52 has been contacted first at 80, controller 54 tries to ascertain if user 16 is moving too slowly for belt 12 or if user 16 is keeping pace with belt 12. Controller 54 determines this by checking to see which sensor 50, 52 is subsequently contacted at 82, 84. If acceleration sensor 50 is contacted next at 84, controller 54 maintains the belt speed at a constant rate because user 16 is contacting the sensors 52, 50 in a manner consistent with keeping pace with the belt speed. However, if deceleration sensor 52 is hit a second consecutive time at 82, controller 54 enters a deceleration mode because user 16 is moving slower than the belt speed.

In the deceleration mode, controller 54 decelerates the speed of the belt 12 at a constant rate at 86, until acceleration sensor 50 is contacted at 88. Upon user 16 contacting acceleration sensor 50, controller 54 halts the deceleration at 90, and reenters normal sensing mode because user 16 has reached the desired belt speed.

The constant acceleration rate is preferably 0.56 miles per hour per second or 0.83 feet per second$^2$, while the constant deceleration rate is preferably 0.75 miles per hour per second or 1.10 feet per second$^2$. The deceleration rate exceeds acceleration rate for safety purposes as it is more important to slow belt 12 down more rapidly if user 16 can no longer maintain pace due to a physical setback, i.e., a muscle cramp, than it is to quickly accelerate belt 12 to the desired speed. However, other acceleration and deceleration rates may be used without departing from the scope of the invention. Further, provisions may also be made on console 28 to permit user 16 to vary the acceleration and deceleration rates within preset limits.

Controller 54 includes a speed limit detector preventing the belt speed from rotating faster than an maximum velocity or slower than a minimum velocity. In the system is in the acceleration mode accelerating belt 12 at a constant rate, the belt speed is sensed in a manner known in the art to display instantaneous speed. If the belt speed is greater than or equal to a predetermined maximum velocity at 92, controller 54 stops accelerating belt 12 at 94 and keeps the speed of belt 12 constant. Upon user 16 contacting deceleration sensor 52 at 96, controller 54 reenters normal sensing mode. Similarly, if controller 54 is decelerating the belt 12 at a constant rate and the speed of belt 12 is less than or equal to a predetermined minimum velocity at 98, controller 54 stops decelerating belt 12 at 100 and keeps the speed of belt 12 constant. Upon user 16 contacting acceleration sensor 50 at 102, controller 54 reenters normal sensing mode. Predetermined maximum and minimum speed limits are 10.0 and 1.0 miles per hour respectively, however, other speed limits may be used as desired, and provisions may be made available to adjust the limits manually by console 28.

The above system is now illustrated by example when user 16 is: (i) keeping pace with the belt speed, (ii) moving faster than the belt speed, and (iii) moving slower than the belt speed. When user 16 is keeping pace with the belt speed, during a normal stride, a first foot (e.g., right foot) of user 16 contacts acceleration sensor 50 first. Due to the movement of belt 12 and user's stride, the right foot should continue to move backwards and contact deceleration sensor 52. Shortly thereafter, the right foot will raise off running surface 14 and the left foot of user 16 will first contact acceleration sensor 50 and near the end of the stride it will subsequently contact deceleration sensor 52. This continued alternating sensor 50, 52 does not change the belt speed at 68 and 72. Thus, the speed of belt 12 will remain constant while user 16 maintains the same pace.

If user 16 is moving at a speed which is faster than the speed of the belt, eventually user 16 will contact acceleration sensor 50 two consecutive times at 68 and 70 because their feet are too far forwards to contact deceleration sensor 54 on the continued stride. This causes controller 54 to accelerate the speed of belt 12 until user 16 contacts deceleration sensor 52 indicating that the desired belt speed has been reached.

If user 16 is moving at a slower speed than the belt, eventually user 16 will contact deceleration sensor 52 two consecutive times at 80 and 82 because their feet will not reach forward enough to contact acceleration sensor 50. This causes controller 54 to decelerate the speed of belt 12 until user 16 contacts acceleration sensor 50 indicating that the desired belt speed has been reached.

Figure 5:
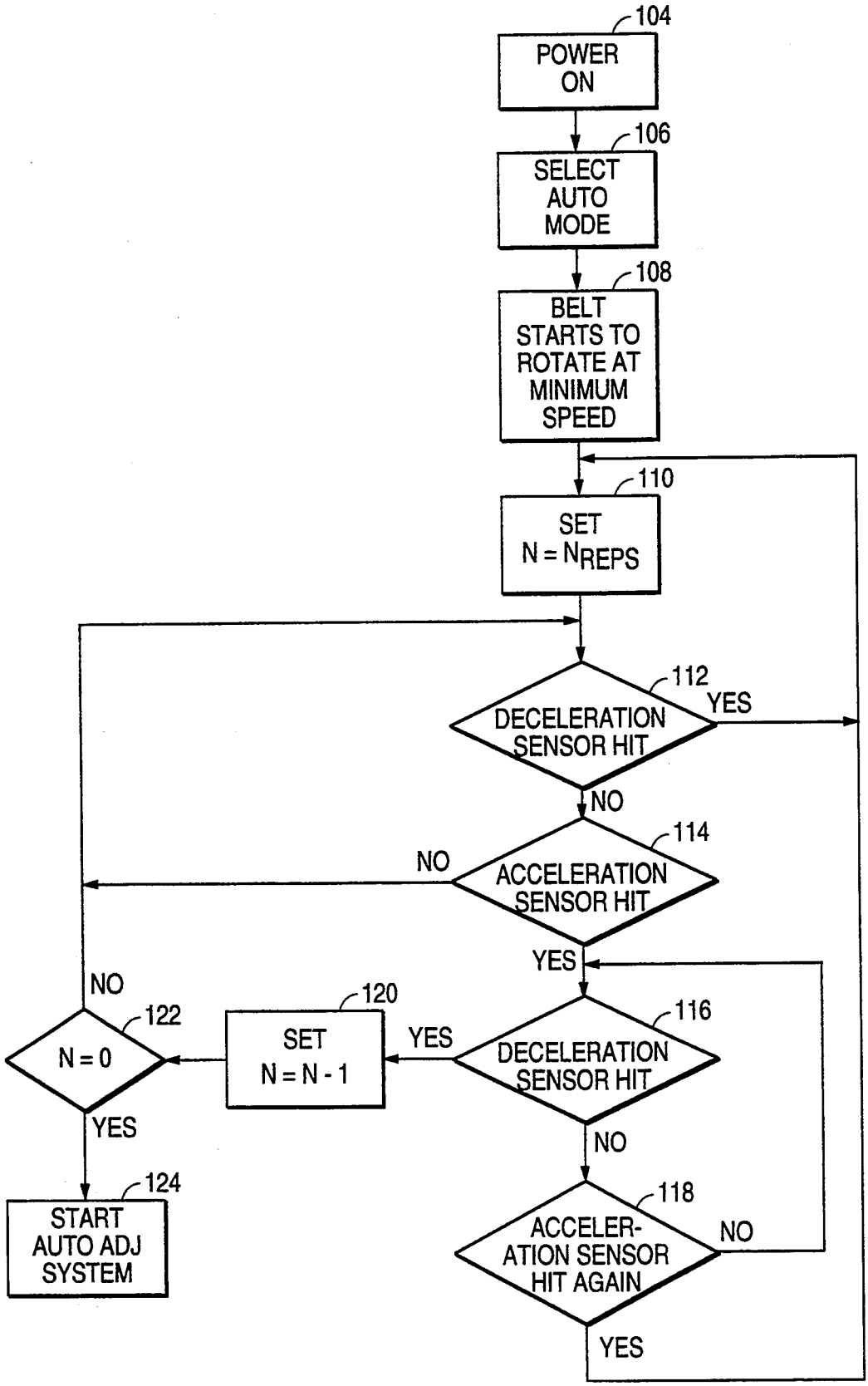
FIG. 5 is a flow chart for a start-up routine for the treadmill of FIG. 1.

Prior to entering the automatic speed control system, user 16 must first successfully complete the start-up routine as shown in FIG. 5. The start-up routine keeps user 5 travelling at a slow start-up speed until they have a proper feel for the center of running surface 14. When controller 54 determines user 16 has a solid feel for the center of running surface 14, the start-up routine is exited and the automatic speed control system initiated. Controller 54 is programmed to determine that user 16 has a feel for the middle of running surface 14 upon user 16 contacting acceleration sensor 50 followed by deceleration sensor 52, a preset number ($N_{reps}$) of consecutive times.

As shown in FIG. 5, the start-up routine is activated by user 16 turning the power on 58 at 104 and selecting the auto mode 60 at 106, both controls preferably being located on console 28. Controller 54 starts belt 12 moving at a predetermined minimum speed at 108 and sets a repetition counter (N) equal to $N_{reps}$ at 110. Controller 54 waits to determine which sensor is contacted first. Contacting deceleration sensor 52 at 112 before acceleration sensor 50, resets the repetition counter to $N_{reps}$. However, if acceleration sensor 50 is contacted at 114, controller 54 then must determine whether acceleration sensor 50 or deceleration sensor 52 is subsequently contacted at 116 and 118. If acceleration sensor 50 is subsequently contacted at 118, then an error from two consecutive acceleration sensor 50 contacts has occurred and the repetition counter is reset to $N_{reps}$ at 110. If deceleration sensor 52 is subsequently contacted at 116, then a proper stride has been sensed and the repetition counter decreases by one increment at 120, i.e., $n=n-1$. If the repetition counter is equal to 0 at 122, then controller 54 determines that user 16 has a feel for the center of running surface 14 and commences the automatic speed control system at 124. If however, the repetition counter has not reached 0, then controller 54 resumes the sensor checking routine, decrementing the repetition counter with each proper stride until the counter equals 0.

The start-up routine determines the user is comfortable with the treadmill sensor spacing upon user 16 performing six consecutive centered strides (i.e., $N_{rep}=6$) of alternatingly contacting sensors 50, 52. However, the start-up routine could be modified, either by software or by manual input to require a higher or lower number of consecutive centered strides without departing from the scope of the invention.

The start-up routine initializes and resets the repetition counter to an integer greater than zero, and decrements upon each proper acceleration sensor 50 and deceleration sensor 52 consecutive contact because in many computer languages, it is quicker to check to see if a variable is equal to zero than if it is equal to another integer. However, the system could easily be designed to initialize and reset the repetition counter to zero and increment until the repetition counter reaches a desired integer greater than zero.

The speed of the belt during the start-up routine is preferably 1.0 miles per hour, as such a speed is a comfortable minimum speed to maintain for the majority of users. However, one of ordinary skill would recognize that the start-up routine minimum speed could be faster or slower, or provisions could even be made to permit the start-up routine minimum speed to be adjustable.

An automatic safety shutoff system automatically initiates upon user 16 turning power on at 126 and selecting either the automatic or manual mode at 128 by controls 58 and 60 respectively. If desired the automatic safety shutoff system is enabled only by the selection of automatic mode, however, it is preferred that the safety shutoff system enable upon the selection of either operational mode. The purpose of shutoff system is to stop motor 36 thereby stopping belt 12, if user 16 has failed to contact a sensor 50, 52 during a period. The period can be set as a function of a belt revolution or it can be function of time.

Figure 6:
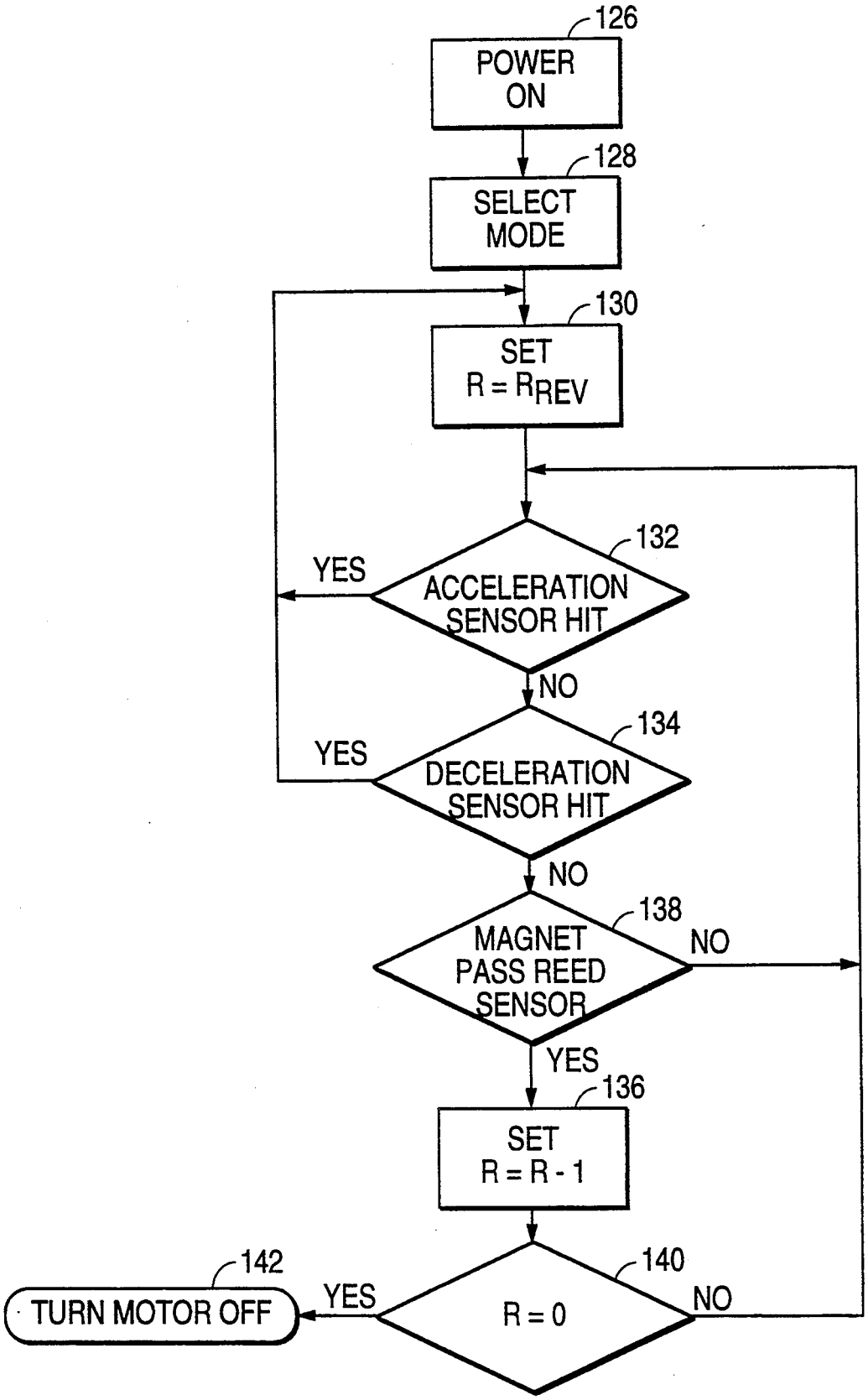
FIG. 6 is a flow chart for an automatic shutoff system for the treadmill of FIG. 1.

FIG. 6 discloses the automatic shutoff system where the period during which the failure to contact a sensor 50, 52 will shut the motor off is related to a fraction of a belt revolution. Upon a failure to contact either acceleration sensor 50 or deceleration sensor 52 for the fraction of a belt revolution, controller 54 stops belt 12 because user 16 has either stepped or fallen off treadmill 10. Although having belt 12 stop automatically when user 16 steps off running surface 14 is a feature of convenience, having belt 12 stop automatically when user 16 has fallen is a feature of safety. For example, if user 16 falls and part of their body is touching the rear of treadmill 10, this system stops belt 12 preventing belt 12 from continuously rotating and causing additional injury to user 16.

Treadmills typically include a sensing arrangement which determines the present belt speed. One such speed sensing device utilizes a magnet, not pictured, located on front roller 30 and a reed switch 56, placed adjacent front roller 30. Each time the magnet on front roller 30 passes the reed switch 56, a pulse is sent to controller 54 which processes these pulses and from which determines the belt speed and the distance covered. The automatic shutoff system utilizes the present magnet and reed switch arrangement to determine a period as a function of a belt revolution.

Front roller 30 has a circumference approximately equal to 1/27th of the length of belt 12. Therefore, for each complete revolution of belt 12, front roller 30 has revolved 27 times, and the magnet would have passed the reed switch 56, 27 times. With this relationship in mind, the automatic shutoff system is discussed in detail.

When the treadmill system is turned on at 126 by on/off control 58 and a mode has been selected at 128 by auto/manual control 60, the automatic shutoff system is automatically initiated. The shutoff system performs three main functions. One function is to determine a period for which a sensor 50, 52 has not been contacted by counting the number of front roller 30 revolutions until a belt 12 revolution has been completed. The second function restarts the period upon a contacting of a sensor 50, 52. The third function is to stop motor 36 upon the completion of the period without sensor 50, 52 contact.

The system includes a revolution counter (R) which is initialized to $R_{rev}$ at 130, the number of roller revolutions corresponding to the desired fraction of belt revolutions for which to stop motor 36 upon a lack of sensor contact. In the preferred embodiment, revolution counter R is set to 27 (i.e., $R_{rev}=27$), setting the system period one belt revolution. However, the period could be set to be shorter or longer than one belt revolution. For example, if a shorter period is desired, for example ⅔rds of a revolution, the revolution counter would be set to initialize to 18, and if a longer period is desired, for example 2 revolutions, the revolution counter would be set to initialize to 54. A contacting of either the acceleration sensor at 132 or the deceleration sensor at 134, resets revolution counter to $R_{rev}$ at 130.

While this is occurring, controller 54 decrements the revolution counter by one increment at 136 for each passing of the reed sensor by the magnet at 138. If the revolution counter is equal to 0 at 140, the routine stops motor 36 at 142 because a sensor 50, 52 has not been contacted during the desired period.

The system initializes and resets the revolution counter to an integer greater than zero, and decrements upon each roller revolution because in many computer languages, it is quicker to check to see if a variable is equal to zero than if it is equal to another integer. However, the system could easily be designed to initialize and reset the revolution counter to zero and increment until the revolution counter reaches a desired integer greater than zero.

Figure 7:
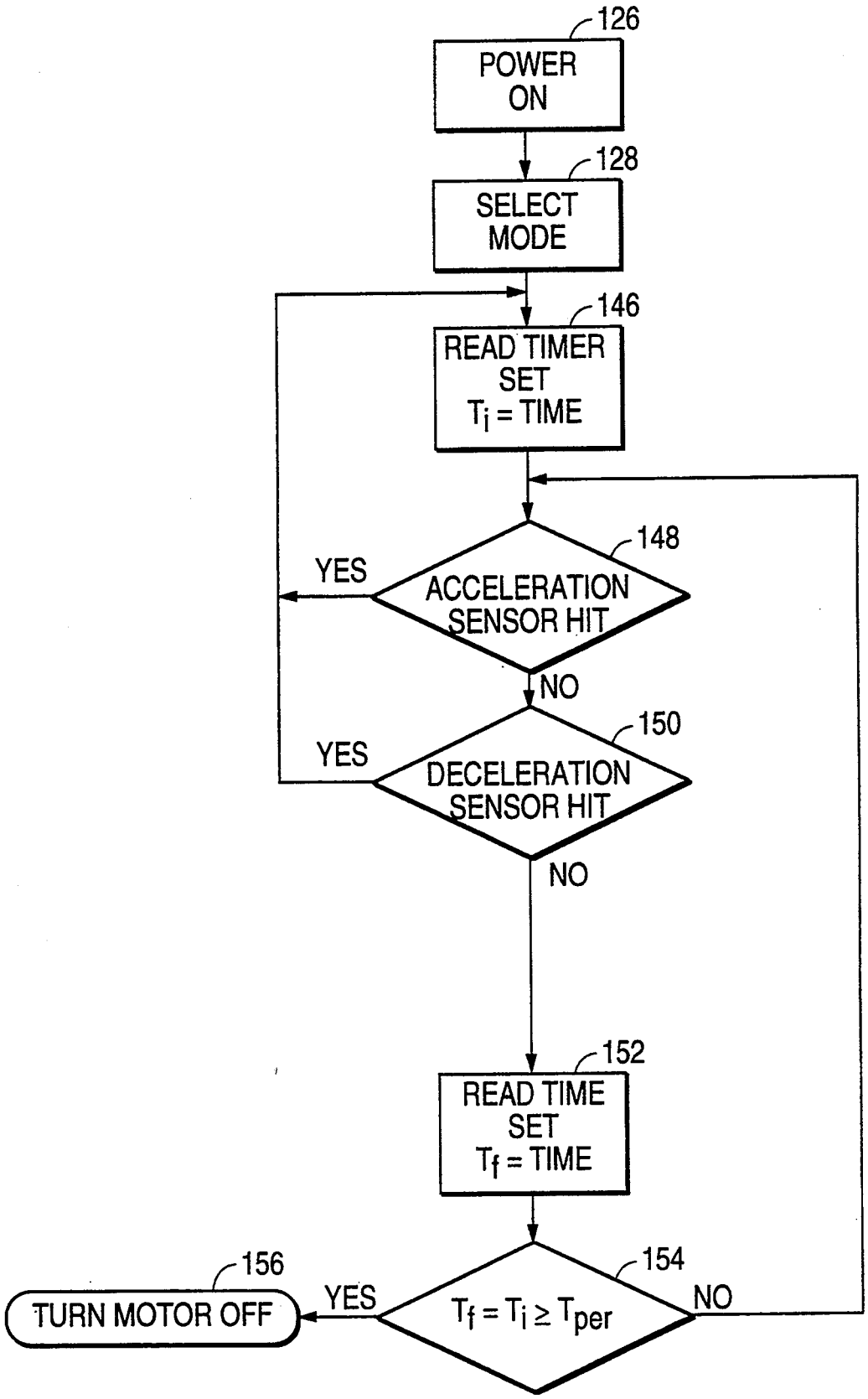
FIG. 7 is a flow chart for a modified automatic shutoff system for the treadmill of FIG. 1.
Figure 8:
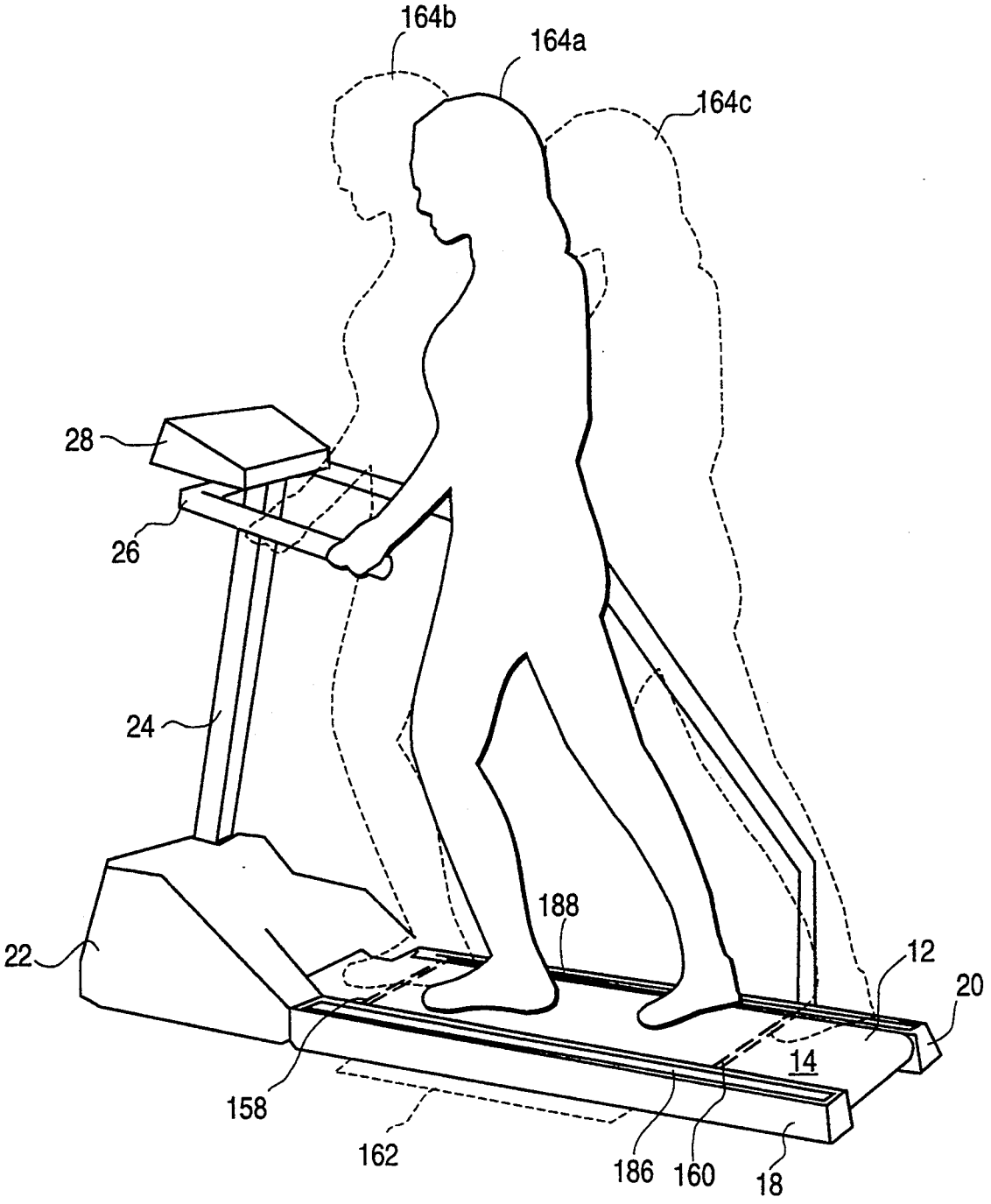
FIG. 8 is a perspective view of a second embodiment of the treadmill according to the present invention.

As controller 54 has a timer 144 built-in, the automatic shutoff routine can be modified to have the sensor non-contact period be a function of time as opposed to a function of a belt revolution. FIG. 7 shows a flow chart of such a modified system. The system has predetermined set time period ($T_{per}$) a period initial time ($T_i$), and a period final time ($T_f$). Upon the initiation of power at and selecting a mode at 126, 128, controller 54 reads the timer and sets $T_i$ equal to the reading at 146. Controller 54 then determines whether a sensor has been contacted at 148 and 150. If a sensor has been contacted, the initial time period ($T_i$) is reread and reset accordingly at 146. If a sensor 50, 52 has not been contacted, the timer is read and the period final time ($T_f$) is set to that reading at 152. Controller 54 then determines whether the present period of a lack of sensor contact exceeds the preset limit ($T_{per}$). This is done by subtracting the initial period time ($T_i$) from the period final time ($T_f$) and comparing it to predetermined set time period ($T_{per}$) at 154. If the period has been exceeded, controller 54 will turn the motor off at 156. However, if the period has not been exceeded, the routine loops back to determine whether a sensor has been contacted.

One example of a reasonable predetermined time period is 3 seconds. However, any other time period may be used and provisions may be made available to adjust the time period as a function of the user's expected speed. For example, if a user typically runs at 8 miles per hour, the time period would preferably be shorter because sensing a fall could be made faster than a user walking at a pace of 1 mile per hour.

A second embodiment of the invention is now described. The second embodiment, as pictured in FIGS. 8–10, differs from the first embodiment by locating the acceleration and deceleration sensors 158, 160 further apart such that a normal running zone 162 is defined therebetween. The second embodiment includes an automatic speed control system and a safety shutoff system, which are different than the systems used in the first embodiment and will be described hereinafter.

The automatic speed control system for the second embodiment operates on the principle that the sensors 158, 160 are placed far enough apart so that a user running in normal running zone 162, will not contact either sensor 158, 160 taking strides at the same speed as the belt. However, a user falling behind not maintaining the pace of the belt, will contact deceleration sensor 160 and the system will incrementally decelerate the belt speed upon each deceleration sensor 160 contact until the user reaches the desired pace determined by their presence inside normal running zone 162. Additionally, a user exceeding the belt speed, will contact acceleration sensor 158 and the system will incrementally accelerate the belt speed upon each acceleration sensor 158 contact until the user reaches the desired pace determined by their presence inside normal running zone 162.

Figure 9:
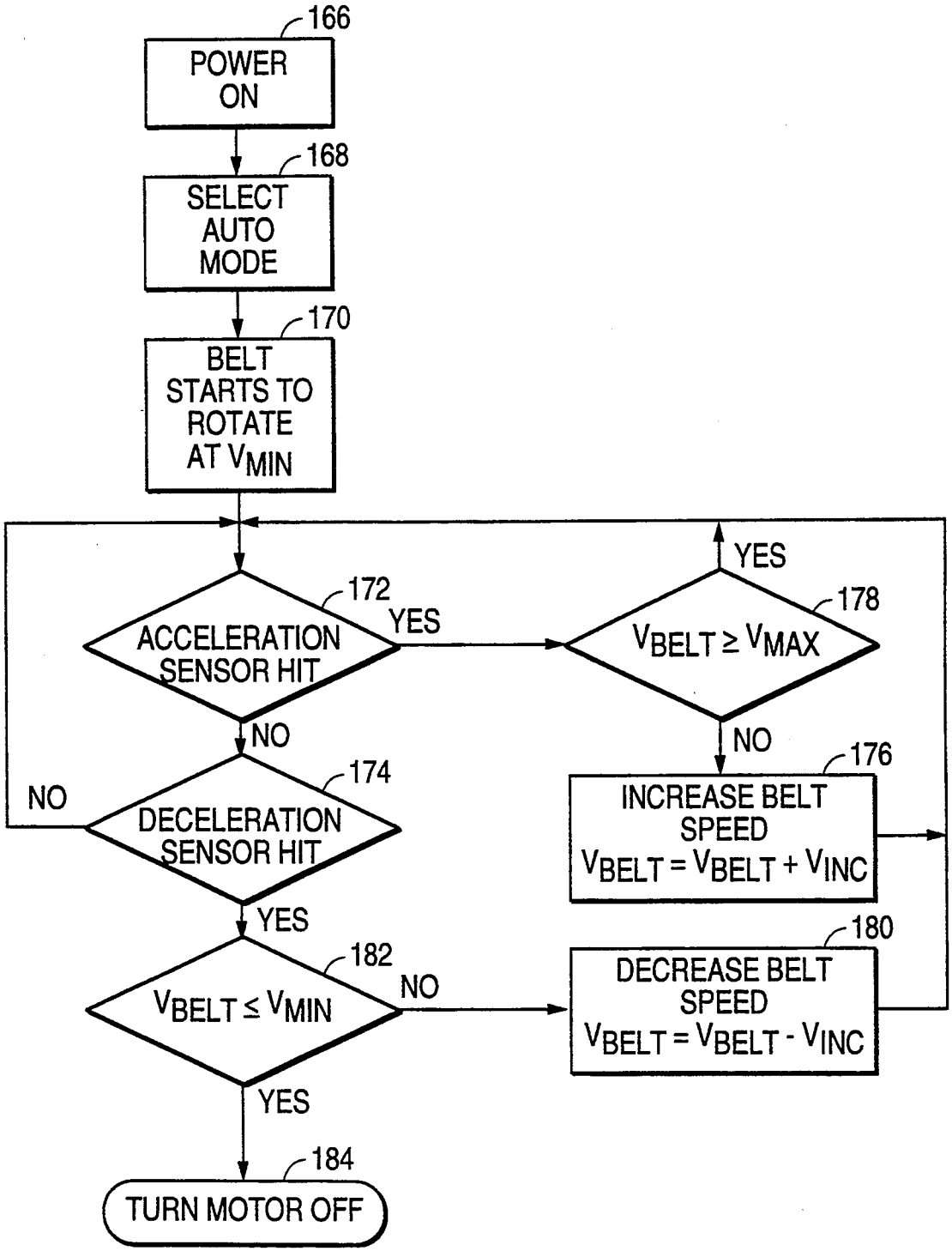
FIG. 9 is a flow chart for the speed control system for the treadmill of FIG. 8.
Figure 10:
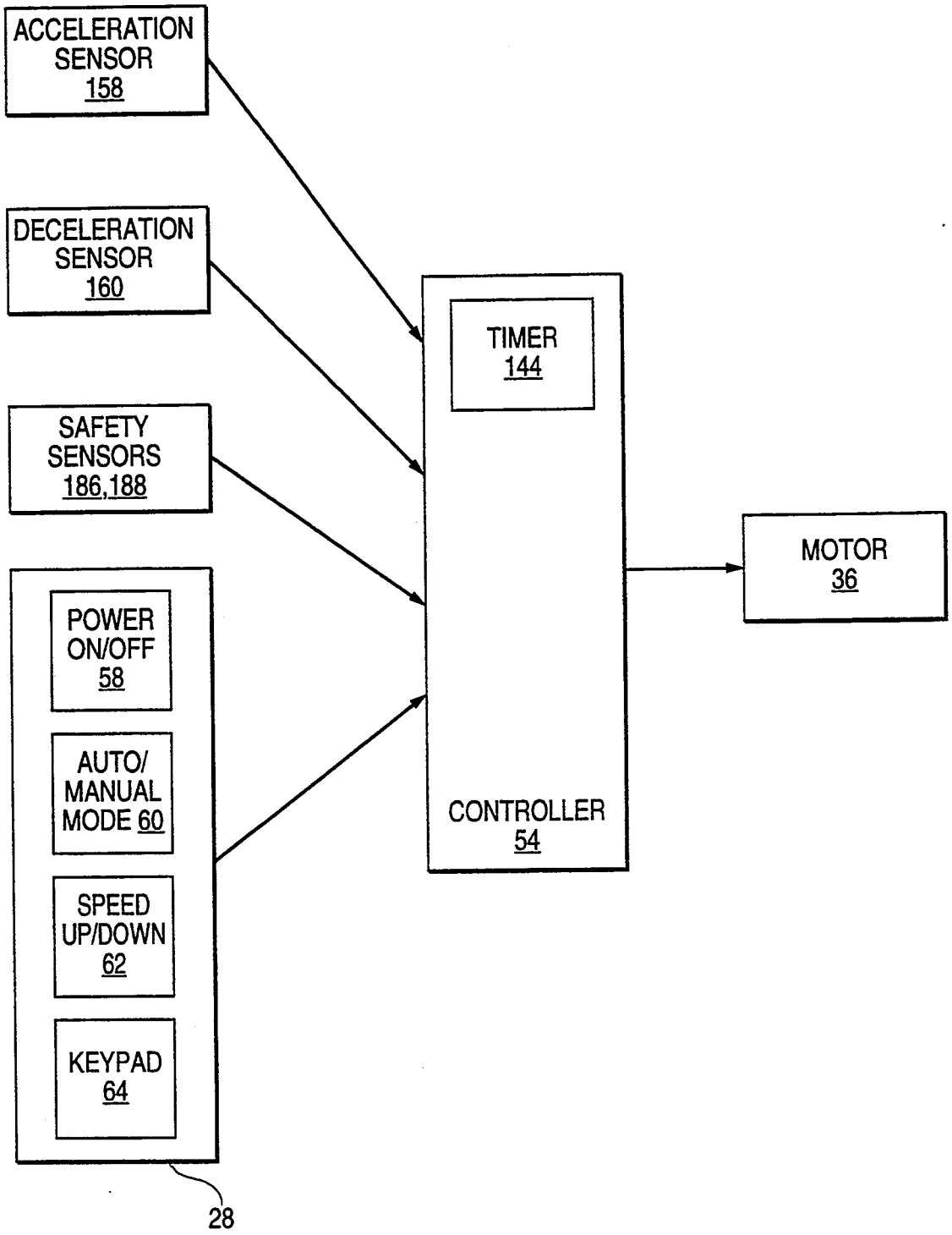
FIG. 10 is a schematic functional diagram of the treadmill of FIG. 8.

The control system for the treadmill of the second embodiment is shown in FIG. 9. To start a workout, user 164*a* manually starts belt 12 in motion by turning the power on at 166 and selecting the automatic mode at 168. In response thereto, belts begins rotating at a preset minimum speed at 170. In this embodiment, a preferred minimum belt velocity would also be 1.0 miles per hour. However, one of ordinary skill would recognize that the start-up routine minimum speed could be faster or slower, or provisions could even be made to permit the start-up routine minimum speed to be adjustable.

The automatic speed control system checks if user 164*a* contacts acceleration sensor 158 or deceleration sensor 160 at 172 and 174. If neither sensor is contacted, controller 54 keeps the belt speed constant.

A user 164*b* moving at a pace exceeding the belt speed will contact acceleration sensor 158 as determined by controller 54 at 172. Contacting acceleration sensor 158 causes controller 54 to increase the belt speed by one speed increment ($V=V+V_{inc}$) at 176, unless the belt speed (V) has reached a maximum predetermined limit ($V_{max}$) at 178. If belt speed has reached its maximum limit, contacting acceleration sensor 158 has no effect upon the belt speed.

A user 164*c* moving at a pace slower the belt speed will contact deceleration sensor 160 as determined by controller 54 at 174. Contacting deceleration sensor 160 causes controller 54 to decrease the belt speed by one speed increment ($V=V-V_{inc}$) at 180, unless the belt speed (V) has reached a minimum predetermined limit ($V_{max}$) at 182. If belt speed has reached its minimum limit, controller 54 stops motor 36 thereby stopping belt 12 at 184.

The value of speed increment can be preprogrammed default value or may be set by the user by pressing the proper sequence of keys on the console. The adjustable speed incremental value is helpful convenience tool for different users. For example, users who keep the same pace for extended period of time would probably want the speed incremental value to be small so as to maintain the desired pace with a minimal fluctuation, while users training to run cross-country or sprinting events would probably want the speed incremental value to be high so as to adjust the pace with maximum responsiveness.

Similar to the first embodiment, predetermined maximum and minimum speed limits are preferably 10.0 and 1.0 miles per hour respectively, however, other speed limits may be used as desired, and provisions may be made available to adjust the limits manually by console 28.

The safety system for the second embodiment includes safety sensors 186, 188 mounted on side rails 18, 20 respectively, so that a user stepping on a side rail 18, 20 causes belt 12 to stop. This is desirable in minimizing further injury to a user who falls downs and contacts a safety sensor 186, 188. In addition to its safety features, its use in the second embodiment acts as a convenience by allowing the user to turn the machine off by stepping on a side rail 16, 18.

Safety sensors 186, 188 are preferably tape switches, pneumatic tubes, piezoelectric sensing elements, or other types of pressure sensing devices which can effectively sense pressure applied thereto by a user.

In both embodiments, auto/manual control 60 on console 28 permits a user to disable the automatic speed control system and manually adjust the belt speed by speed up/down control 62 preferably located on console 28. Additionally, speed up/down control 62 adjusts the belt speed, even while in the automatic mode.

While particular embodiments of the invention have been shown and described, it is recognized that various modifications thereof will occur to those skilled in the art. Therefore, the scope of the herein-described invention shall be limited solely by the claims appended hereto.

What is claimed is:

1. An exercise apparatus comprising:

a movable endless belt having an upper run for a user to stride upon;

a motor for moving the belt;

at least one sensor located below the upper run of the belt for sensing the position of the user on the belt; and a controller for controlling the speed of the endless belt in accordance with the position of the user relative to said at least one sensor.

2. The exercise apparatus as claimed in claim 1, wherein the belt is supported on and moves over a bed, and said at least one sensor being located on the bed.

3. The exercise apparatus as claimed in claim 2, wherein the bed comprises an upper surface, and the upper surface of said bed has cushioning material over which the belt moves, and said at least one sensor being located adjacent the cushioning material.

4. The exercise apparatus as claimed in claim 1, wherein the exercise apparatus has a front and a rear, said at least one sensor comprises front and rear sensors, the rear sensor being mounted rearwardly of the front sensor, the controller increasing the speed of the endless belt when the front sensor senses the proximate position of the user, and decreasing the speed of the endless belt when the rear sensor senses the proximate position of the user.

5. The exercise apparatus as claimed in claim 4, wherein the front and rear sensors sense the position of the user by pressure exerted thereupon by the user.

6. The exercise apparatus as claimed in claim 5, wherein the front and rear sensors each comprises a pneumatic tube.

7. The exercise apparatus as claimed in claim 5, wherein the front and rear sensors each comprises a tape switch.

8. The exercise apparatus as claimed in claim 5, wherein the front and rear sensors each comprises a piezo electric sensing element.

9. The exercise apparatus as claimed in claim 4, wherein the controller stops the motion of the endless belt when the endless belt is moving below or at a predetermined speed and the rear sensor senses the proximate position of the user.

10. The exercise apparatus as claimed in claim 4, further comprising a safety sensor mounted on an upper surface of a member located proximate said belt, and said controller stops the motion of endless belt when the safety sensor senses the proximate position of the user.

11. The exercise apparatus as claimed in claim 4, wherein the belt revolves around a bed and the controller stops the motion of the endless belt upon the failure of both said sensors to sense the proximate position of the user during the course of belt revolving around the bed.

12. The exercise apparatus as claimed in claim 11, wherein the controller stops the motion of the endless belt upon the failure of both said sensors to sense the proximate position of the user within a predetermined fraction of a belt revolution.

13. The exercise apparatus as claimed in claim 11, wherein the controller stops the motion of the endless belt upon the failure of both said sensors to sense the proximate position of the user within a predetermined period of time.

14. The exercise apparatus as claimed in claim 4, wherein the controller:

increases the speed of the endless belt upon two consecutive occurrences of the front sensor sensing the proximate position of the user;

decreases the speed of the endless belt upon two consecutive occurrences of the rear sensor sensing the proximate position of the user; and maintains the speed of the endless belt at a constant rate upon an occurrence of the front sensor sensing the proximate position of the user following an occurrence of the rear sensor sensing the proximate position of the user, and upon an occurrence of the rear sensor sensing the proximate position of the user following an occurrence of the front sensor sensing the proximate position of the user.

15. A control system for an exercise apparatus having at least one movable support surface for supporting a user and a motor for moving said support surface, the control system comprising:

a controller;

a front sensor providing a signal to the controller in response to pressure exerted by a user on said support surface proximate thereto;

a rear sensor providing a signal to the controller in response to pressure exerted by the user on said support surface proximate thereto; and wherein the controller increases the speed of the support surface in response to receiving a signal from the front sensor and the controller decreases the speed of the support surface in response to receiving a signal from the rear sensor.

16. The control system as claimed in claim 15, wherein the front and rear sensor each comprises a pressure switch.

17. The control system as claimed in claim 16, wherein the pressure switches each comprises a pneumatic tube.

18. The control system as claimed in claim 16, wherein the pressure switches each comprises a piezo electric sensing element.

19. The control system as claimed in claim 16, wherein the pressure switches each comprises a tape switch.

20. The control system as claimed in claim 15, wherein the exercise apparatus is a treadmill.

21. A method of controlling the speed of an endless surface on an exercise machine having a motor for moving the endless surface, a controller for controlling the speed of the motor, and front and rear sensors for sensing the position of a user, said method comprising:

moving the endless surface at a constant speed;

accelerating the endless surface upon two consecutive sensings of the user by the front sensor;

terminating the accelerating step upon a sensing of the user by the rear sensor;

decelerating the endless surface upon two consecutive sensings of the user by the rear sensor; and terminating the decelerating step upon a sensing of the user by the front sensor.

22. The method of claim 21, further comprising:

maintaining the speed of the endless surface constant upon the sensing of the user by the front sensor followed by the sensing of the user by the rear sensor; and maintaining the speed of the endless surface constant upon the sensing of the user by the rear sensor followed by the sensing of the user by the front sensor.

23. The method of controlling the speed of exercise equipment as claimed in claim 21, wherein the endless surface is rotatable and the exercise machine includes means to determine fractions of revolutions made by the endless surface, said method further comprising:

sensing a revolution amount made by the rotatable endless surface: and stopping the motion of the support surface in response to the failure of sensing the position of the user by the front and rear sensors within the revolution amount.

24. The method of controlling the speed of exercise equipment as claimed in claim 21, wherein said exercise equipment includes means to detect expiration of a time period, said method further comprising:

stopping the motion of the support surface in response to the failure of detecting the position of the user by the front and rear sensors within the time period.

25. An exercise apparatus comprising:

a movable endless belt having an upper run for a user to stride upon;

a motor for moving the belt;

at least one sensor for sensing the position of the user on the belt; and a controller for stopping the endless belt upon the failure of said at least one sensor to sense the position of the user.

26. The exercise apparatus as claimed in claim 25, wherein said at least one sensor comprises a front sensor and a rear sensor, said controller stops the motion of the endless belt upon the failure of both said sensors to sense the position of the user.

27. The exercise apparatus as claimed in claim 26, wherein the controller stops the motion of the endless belt upon the failure of said sensors to sense the position of the user within a predetermined fraction of a belt revolution.

28. The exercise apparatus as claimed in claim 26, wherein the controller stops the motion of the belt upon the failure of said sensors to sense the position of the user within a predetermined period of time.

29. The exercise apparatus as claimed in claim 26, wherein said sensors are located below the upper run of the belt.

30. A method of controlling exercise equipment having an endless surface, a motor for driving the endless support surface, a controller for controlling the speed of the motor, and front and rear sensors for detecting the position of a user, said method comprising:

moving the endless support surface;

detecting the relative position of the user on the endless support surface by the front and rear sensors;

comparing the detections of the relative position of the user on the endless support surface by the front and rear sensors to a sequence of detected relative positions, the sequence including a predetermined order of detected relative positions by the front and rear sensors; and initiating a speed control system upon completion of said comparing step if the detected relative positions of the user on the endless support surface by the front and rear sensors are in the same order as the sequence of detected relative positions.

31. The method of claim 30, further including the steps of:

accelerating the endless support surface upon two consecutive detections of the user by the front sensor;

terminating the accelerating step upon a detection of the user by the rear sensor;

decelerating the endless support surface upon two consecutive detections of the user by the rear sensor;

terminating the decelerating step upon a detection of the user by the front sensor;

maintaining the speed of the endless support surface constant upon the detection of the user by the front sensor followed by the detection of the user by the rear sensor; and maintaining the speed of the endless support surface constant upon the detection of the user by the rear sensor followed by the detection of the user by the front sensor.

* * * * *